United States Patent [19]

Masuda et al.

[11] Patent Number: 4,656,998

[45] Date of Patent: Apr. 14, 1987

[54] FOLDABLE MASSAGE BED WITH RECIPROCATING ROLLERS

[75] Inventors: Teruo Masuda, Tokyo; Kichiro Yamaguchi, Kumagaya, both of Japan

[73] Assignee: France Bed Co., Ltd., Tokyo, Japan

[21] Appl. No.: 782,708

[22] Filed: Oct. 1, 1985

[30] Foreign Application Priority Data

Oct. 5, 1984 [JP] Japan ..... 59-150925[U]
Oct. 9, 1984 [JP] Japan ..... 59-211660

[51] Int. Cl.[4] ..... A61H 11/02; A61H 15/00

[52] U.S. Cl. ..... 128/57; 128/58; 128/52

[58] Field of Search ..... 128/58, 57, 52

[56] References Cited

U.S. PATENT DOCUMENTS

| | | | |
|---|---|---|---|
| Re. 26,725 | 11/1969 | Sellner | 128/57 |
| 2,004,428 | 6/1935 | Davies | 128/57 |
| 2,693,797 | 11/1954 | Schrock | 128/58 |
| 2,841,141 | 7/1958 | Hudgins | 128/57 |
| 3,405,709 | 10/1968 | Mathers | 128/57 |
| 3,664,333 | 5/1972 | Hill | 128/57 |
| 3,687,133 | 8/1972 | Grubeliz | 128/58 |
| 3,707,284 | 12/1972 | Waldeck | 128/57 |
| 4,173,972 | 11/1979 | Kodero | 128/52 |
| 4,373,516 | 2/1983 | Masuda et al. | 128/57 |
| 4,412,534 | 11/1983 | Hamabe et al. | 128/52 |

FOREIGN PATENT DOCUMENTS

| | | | |
|---|---|---|---|
| 2036920 | 2/1971 | Fed. Rep. of Germany . | |
| 2027767 | 12/1971 | Fed. Rep. of Germany . | |
| 3048292 | 9/1981 | Fed. Rep. of Germany . | |
| 3116848 | 1/1982 | Fed. Rep. of Germany . | |
| 3240125 | 5/1984 | Fed. Rep. of Germany | 128/57 |

*Primary Examiner*—Edgar S. Burr
*Assistant Examiner*—Tonya Eckstine
*Attorney, Agent, or Firm*—Frishauf, Holtz, Goodman & Woodward

[57] ABSTRACT

A massage apparatus includes a foldable base plate, carriers with massage rollers thereon capable of running on the base plate, a pair of guide members arranged on the base plate and foldable together therewith, each having therein passages, and a drive mechanism for reciprocating the driving belt in the passages to transmit driving force to the carriers.

16 Claims, 31 Drawing Figures

FOLDABLE MASSAGE BED WITH RECIPROCATING ROLLERS

Background of the Invention

The present invention relates to a massage apparatus, and more specifically to a mattress-type massage apparatus for massaging a user lying on it.

A massage apparatus of this mattress-type is disclosed in U.S. Pat. No. 4,373,516. This conventional massage apparatus comprises an enclosure in the form of a mattress, a rigid base plate contained in the enclosure, a pair of rigid guide rails arranged on the base plate and extending parallel to each other, and a massage roller capable of reciprocating along the guide rails. A user lies on the enclosure while the massage roller is reciprocating along the guide rails.

However, the user cannot have his whole body massaged by this massage apparatus unless the guide rails and the base plate are longer than the user is tall. The enclosure must be at least two meters long, making the massage apparatus sufficiently large. When the massage apparatus is large it requires a large space for storage. Owing to its elongate structure, moreover, the massage apparatus is too bulky to carry about.

SUMMARY OF THE INVENTION

The primary object of the present invention is to provide a mattress-type massage apparatus which can be folded at least in two.

The above object of the present invention may be achieved by a massage apparatus which comprises an elongate base plate foldable at least in two, at least one carrier capable of running on the base plate, the carrier having at least one massage roller, drive means for reciprocating the carrier in the longitudinal direction of the base plate, the drive means including at least one elongate member extending in the longitudinal direction of the base plate and coupled to the carrier and a drive source for driving the elongate member for reciprocation, and at least one guide member disposed on the base plate so as to extend in the longitudinal direction thereof and foldable together with the base plate, the guide member including passage means for guiding the drive of the elongate member, thereby guiding the running carrier.

According to the massage apparatus of the present invention, both the base plate and the guide member are foldable. When not in use, therefore, the massage apparatus can be folded up for storage, permitting a reduction of the storage space therefor. As the massage apparatus is folded, moreover, it is easy to carry about. Since the elongate member of the drive means is guided inside the passage means of the guide member, it is prevented from being caught by any other members or getting entangled when the massage apparatus is folded up. Also, the path of transfer of the elongate member is restricted by the passage means of the guide member, so that the running carrier can be guided by the cooperation of the elongate member and the passage means. Thus, the carrier can be prevented from meandering while it is reciprocating, ensuring the user a satisfactory massaging effect.

The above and other objects and advantages of the invention will be apparent in the following detailed description of illustrative embodiments thereof which is to be read in connection with the accompanying drawings.

DETAILED DESCRIPTION OF THE PREFERRED EMBODIMENTS

Figure 1:
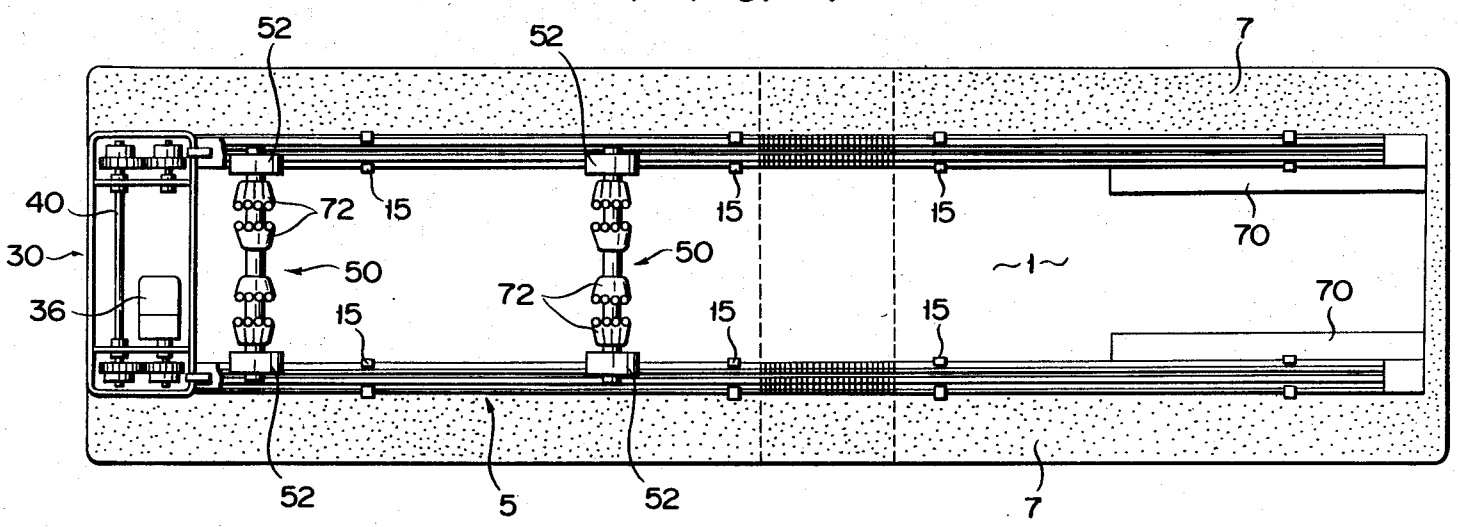
FIG. 1 is a plan view of a massage apparatus according to a first embodiment of the present invention with its wrapping cloth removed.
Figure 2:
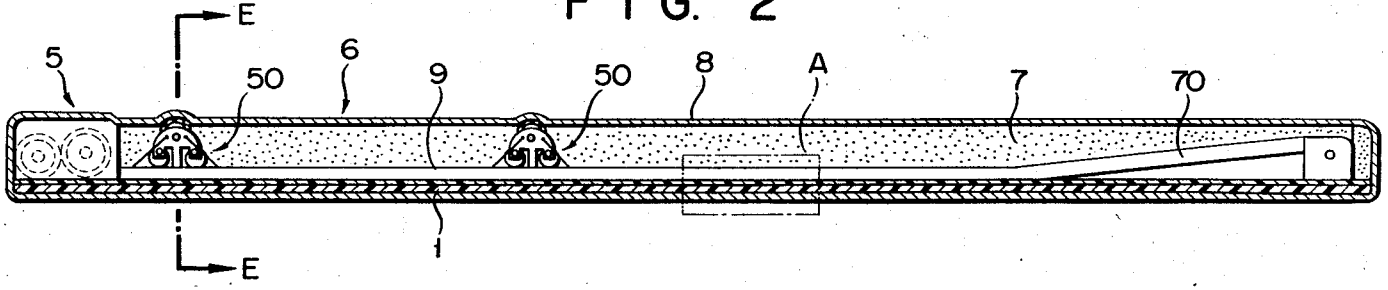
FIG. 2 is a sectional view of the massage apparatus of FIG. 1.
Figure 3:
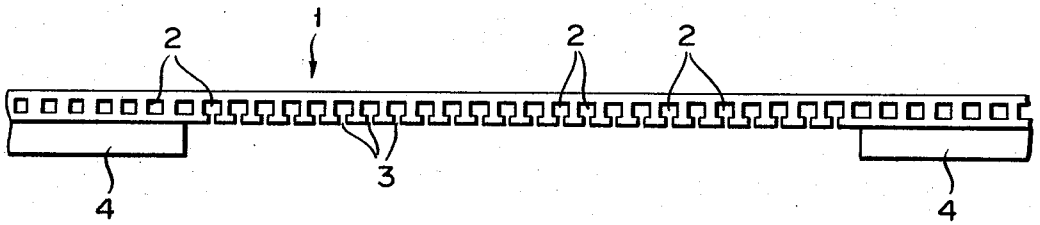
FIG. 3 is an enlarged side view showing that portion of a base plate corresponding to section A of FIG. 2.

Referring now to FIGS. 1 and 2, there is schematically shown a mattress-type massage apparatus according to the present invention. The massage apparatus is provided with a rectangular base plate 1. The base plate 1 is integrally formed of a synthetic resin, such as nylon, polypropylene, polyvinyl chloride or urethane, having the configuration mentioned below and a measure of flexibility. As shown in FIG. 3, the base plate 1 has a number of cavities 2 having a rectangular cross section and extending parallel to the shorter sides of the base plate 1. Each cavity 2 extends from one longer side of the base plate 1 to the other longer side. The cavities 2 are arranged at regular intervals in the longitudinal direction of the base plate 1. Those cavities 2, which are located in the central portion of the base plate 1 indicated by symbol A of FIG. 2, open to the undersurface of the base plate 1 through slits 3. Like the cavities 2, the slits 3 extend across the base plate 1. The base plate 1 can be folded in two at its predetermined folding portion or section A (FIG. 2) since the folding portion is sufficiently flexible. In FIG. 2, the base plate 1 is shown only schematically, and neither the cavities 2 nor the slits 3 are shown.

As shown in FIG. 3, two reinforcing plates 4 may be coupled to those portions of the base plate 1, on both sides of the section A. The plates 4 are made of the same material as the base plate 1.

A massage device 5 (described later) is mounted on the base plate 1. The base plate 1 and massage device 5 are covered with a covering 6 comprising a cushion portions 7 and a wrapping cloth 8. The cushion portions 7 surrounding the device 5 are made of elastic material, such as urethane foam. The wrapping cloth 8 is shaped like an enclosure and made of canvas, nylon cloth or other cloth with a relatively high wear resistance.

Referring now to FIGS. 4 to 13, the massage device 5 inside the covering 6 will be described in detail. The massage device 5 has a pair of guide members 9. The guide members 9 are arranged on the base plate 1 at a predetermined space, extending parallel along the longer sides of the base plate 1. Like the base plate 1, the guide members 9 are formed of a synthetic resin and are flexible.

Figure 10:
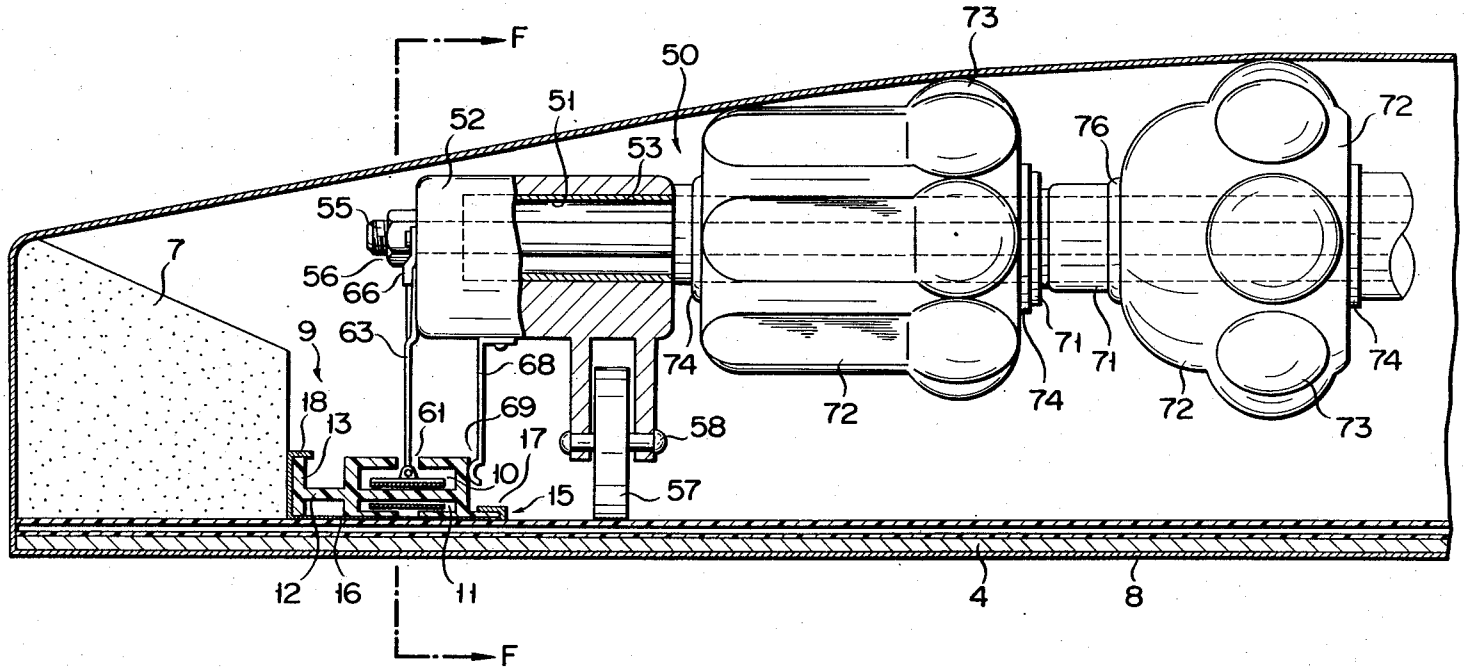
FIG. 10 is a sectional view taken along line E—E of FIG. 2.

As best seen from FIG. 10, an upper passage 10 and a lower passage 11 are defined inside each of the guide members 9, extending along the longitudinal direction of the guide member 9. A belt portion 12 protrudes integrally from that lateral face of each guide member 9 extending along the guide member 9. A protrusion 13 having an I-shaped cross section extends vertically from the edge of the belt portion 12.

Figure 4:
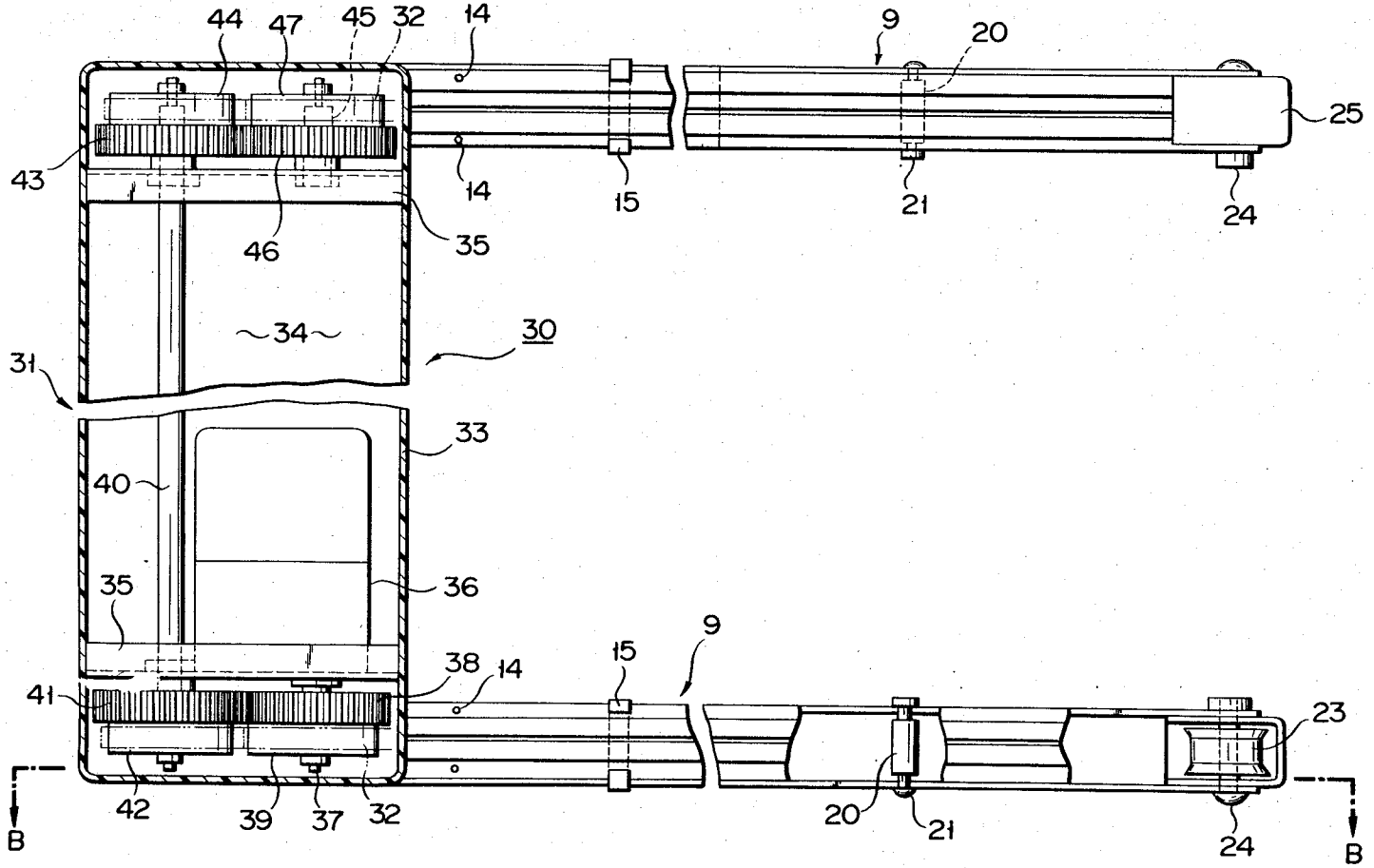
FIG. 4 is a plan view of a drive mechanism used in the massage apparatus of FIG. 1.

As shown in FIG. 4, only one end portion of each guide member 9 is fixed to the base plate 1 by means of fixing screws 14. The other end side of each guide member 9 is slidably supported by a plurality of support members 15 as shown in FIGS. 1, 4 and 10. In FIG. 4, only one support member 15 is illustrated for each guide member 9. As shown in detail in FIG. 10, each support member 15 includes an intermediate strip portion 16 located between the lower surface of the guide member 9 and the upper surface of the base plate 1 and fixed to the base plate 1 by means of setscrews (not shown), a first holding portion 17 on one side edge of the intermediate strip portion 16 for slidably holding a lower edge portion of the guide member 9, and a second holding portion 18 on the other side edge of the intermediate strip portion 16 for slidably holding the protrusion 13 of the guide member 9.

Figure 5:
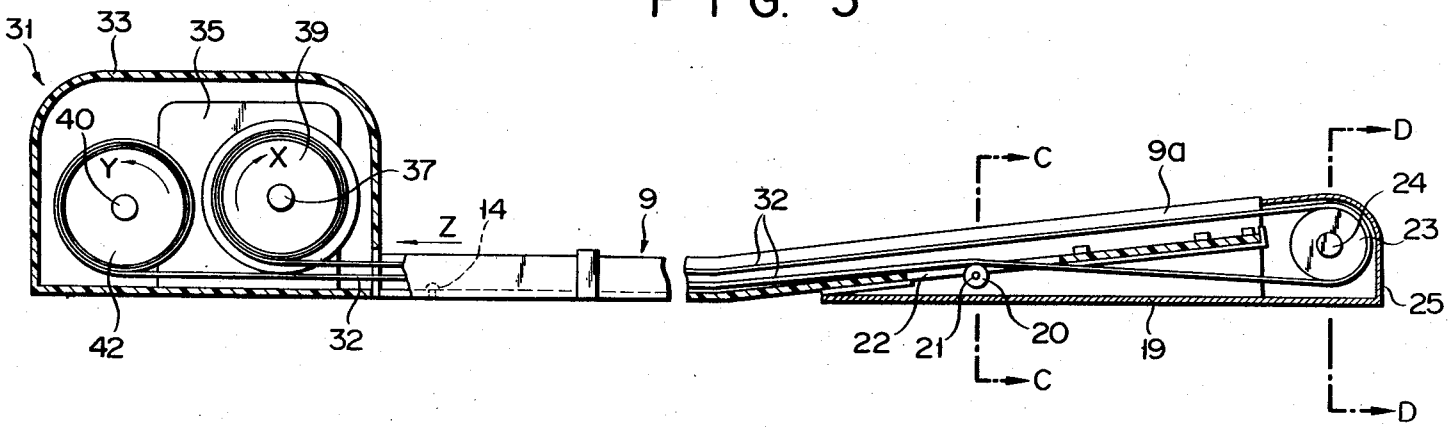
FIG. 5 is a sectional view taken along line B—B of FIG. 4.
Figure 6:
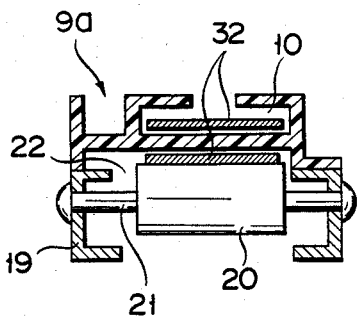
FIG. 6 is a sectional view taken along line C—C of FIG. 5.
Figure 7:
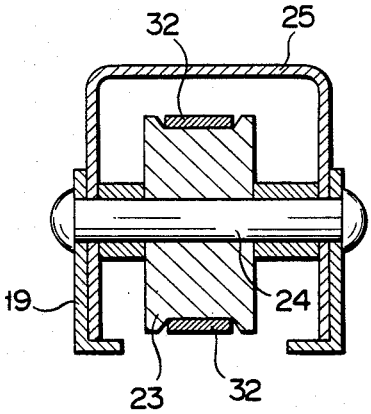
FIG. 7 is sectional view taken along line D—D of a FIG. 5.

As shown in FIG. 5, the other end side portion of each guide member 9 is bent upward or away from the upper surface of the base plate 1. This bent portion 9*a* of the guide member 9 is held on a slope frame 19. As shown in FIG. 6, a pitching roll 2 is rotatably supported inside the slope frame 19 at one end portion thereof by means of a support shaft 21. The pitching roll 20 projects slightly from the upper surface of the slope frame 19 through an opening 22 in the top wall of the slope frame 19. As shown in FIG. 6, moreover, those lower parts of the guide member 9 which correspond to the opening 22 of the slope frame 19 are partially cut away. As shown in FIG. 7, a pulley 23 is rotatably supported inside the other end side portion of the slope frame 19 projected from the guide member 9 by means of a support shaft 24. The other end portion of the slope frame 19 is closed by a cap 25.

Figure 8:
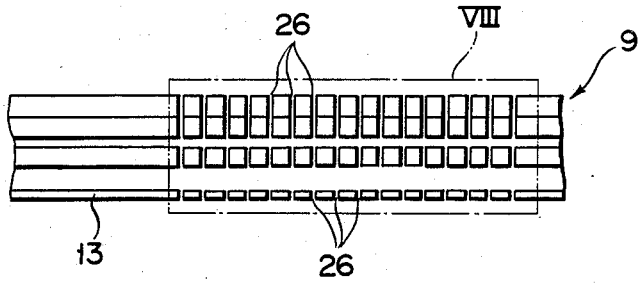
FIG. 8 is a plan view showing part of a guide member.
Figure 9:
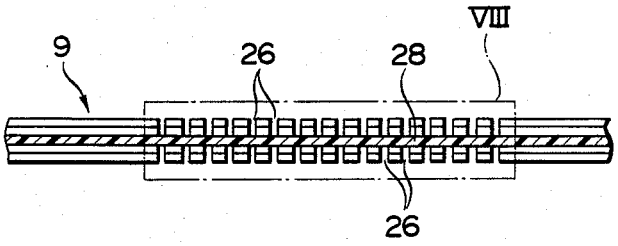
FIG. 9 is a sectional view of the guide member corresponding to FIG. 8.

As shown in FIGS. 8 and 9, a number of slits 26 are formed in that region of each guide member 9 which corresponds to the predetermined folding portion of the base plate 1 indicated by symbol A in FIG. 2. As shown in FIG. 7, these slits 26 are arranged across the width of the guide members 9 except for a intermediate strip portion 28 thereof. Therefore, the region indicated by symbol VIII in FIGS. 8 and 9, like the predetermined folding portion of the base plate 1, is expressly flexible, and the each guide member 9 can be folded in two at the predetermined fold portion or at region VIII.

A drive mechanism 30 is mounted on the base plate 1. The drive mechanism 30 comprises a drive unit 31 set on the one end portion of the base plate 1 so as to adjoin the one end of each guide member 9, and a pair of driving belts 32 driven by the drive unit 31. The drive unit 31 is provided with a unit case 33. The unit case 33 extends between the two guide members 9. As shown in FIG. 4, a mounting board 34 is housed in the unit case 33. The mounting board 34 is fixed on the top of the base plate 1. The mounting board 34 comprises standing plate portions 35 on both end edges of thereof near the guide members 9. Disposed between the two standing plate portions 35 of the mounting board 34 is a unit motor 36 which is combination of an electric motor and a reducer. The unit motor 36 is a reversible motor whose output shaft 37 extends to the outside through one of the standing plate portions 35 of the mounting board 34. A first driving gear 38 formed of a spur gear and a first driving pulley 39 are successively mounted on the output shaft 37 of the unit motor 36, located outside the mounting board 34. Between the standing plate portions 35 of the mounting board 34, a first drive shaft 40 extends parallel to the output shaft 37 of the unit motor 36. Both end portions of the first drive shaft 40 extend through the standing plate portions 35 of the mounting board 34 to the outside thereof. Thus, the first driven shaft 40 is rotatably supported between the two standing plate portions 35. On end portion of the first driven shaft 40 near the unit motor 36 is successively fitted with a first driven gear 41 in mesh with the first driving gear 38 and a first driven pulley 42 paired with the first driving pulley 39. A second driving gear 43 formed of a spur gear and a second driving pulley 44 are successively mounted on the other end portion of the first driven shaft 40, located outside the other standing plate portion 35. A second driven shaft 45 parallel to the first driven shaft 40 is rotatably supported on that standing plate portion 35 of the mounting board 34 which rotatably supports the other end portion of the first driven shaft 40. The second driven shaft 45 extends to the outside of the standing plate portion 35. The second driven shaft 45 is fitted with a second driven gear 46 to mesh with the second driving gear 43, and a second driven pulley 47 which is paired with the second driving pulley 44. The gears 38, 41, 43 and 46 are all rotated at the same speed.

One of the paired driving belts 32 formed of, e.g., steel, stainless steel for transmitting power is wound around the first driving pulley 39. One end of this driving belt 32 is fixed to the first driving pulley 39. As shown in FIG. 5, one driving belt 32 is let out the first driving pulley 39 into the upper passage 10 of the one guide member 9, extends along the upper passage 10, and is passed around the pulley 23 to change its course about 180°. Then, the driving belt 32 is passed through the interior of the slope frame 19 and the opening 22 thereof, turns to a somewhat different direction on the pitching roll 20, and is led to the first driven pulley 42 through the lower passage 11 of the guide member 9. Also at the first driven pulley 42, the driving belt 32 is wound around the first driven pulley 42 with its other end fixed thereto. In FIG. 5, the guide member 9 is illustrated as a mere hollow passage for simplicity.

The other driving belt 32 is guided through the other guide member 9, and wound around the second driving pulley 44 and the second driven pulley 47.

According to the drive mechanism 30 with this construction, when the output shaft 37 of the unit motor 36 is rotated, for example, in the direction of arrow X in FIG. 5, the first driving pulley 39 rotates to be wound with the driving belt 32. Since the first driven pulley 42 is rotated in the opposite direction to the first driving pulley 39, the driving belt 32 is let out from the first driven pulley 42 in proportion to the length of the portion of the belt 32 wound on the first driving pulley 39. In this case, therefore, the portion of the driving belt 32 guided through the upper passage 10 of the one guide member 9 is run in the direction of arrow Z in FIG. 5. In this case, moreover, the second driving pulley 44 is rotated in the same direction as the first driven pulley 42, and the second driven pulley 47 is rotated in the same direction as the first driving pulley 39. Accordingly, the driving belt 32 guided through the upper passage 10 of the other guide member 9 is run also in the direction of arrow Z in synchronism with the driving belt 32 running through the one guide member 9.

Figure 11:
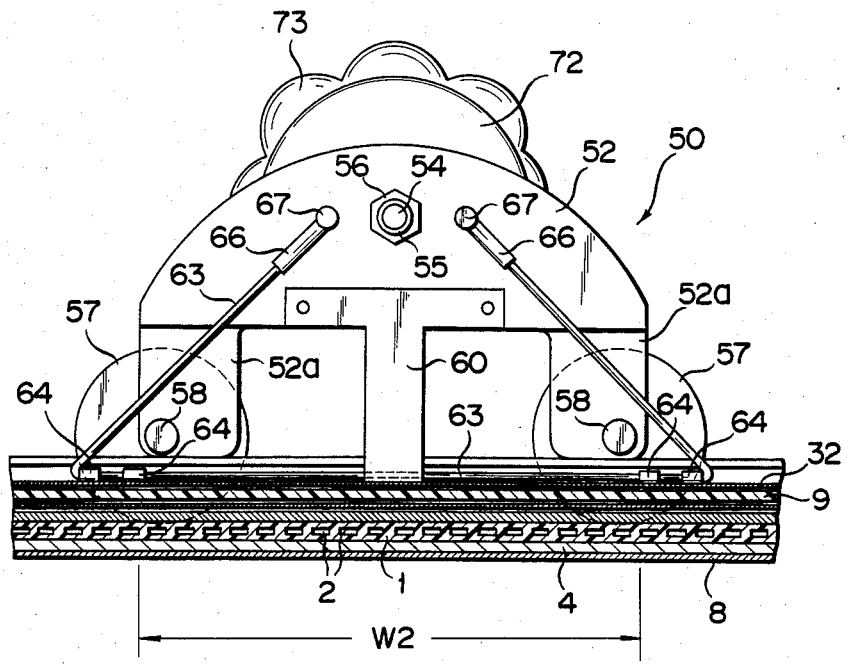
FIG. 11 is a sectional view taken along line F—F of FIG. 10.
Figure 12:
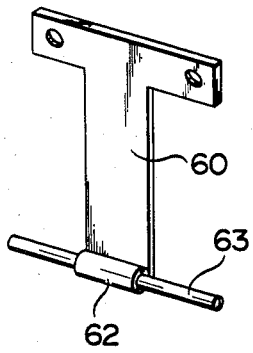
FIG. 12 is a perspective view of a coupler attached to a support leg shown in FIG. 11.
Figure 13:
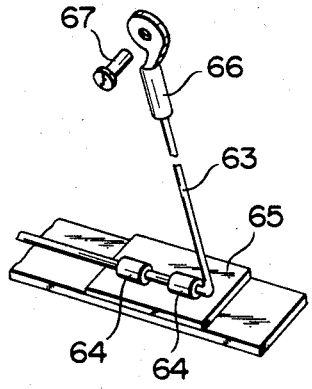
FIG. 13 is a perspective view showing part of a wire connecting the support leg and a driving belt shown in FIG. 11.

As shown in FIGS. 1 and 2, two carriers 50 are arranged between the pair of guide members 9 at a predetermined space in the longitudinal direction of the guide members 9. Since these carriers 50 have the same construction, only one of them will be described in detail. As shown in FIG. 10, the carrier 50 is provided with a hollow shaft 51 which extends at right angles to the guide members 9. Each end portion of the hollow shaft 51 is fitted in a fitting hole 53 formed in a support leg 52 on each side. FIG. 10 shows only one side of the structure. A support shaft 54 is coaxially passaged through the hollows shaft 51. Both end portions of the support shaft 54 are formed into screw portions 55. Thus, the support shaft 54 is fixed to the support leg 52 by screwing a nut 56 on each screw portion 55. As shown in FIGS. 10 and 11, a pair of wheels 57 are rotatably attached to leg portions **52*a* of the support leg 52 by means of support shafts 58. The wheels 57 are arranged one the base plate 1 so as to be able to run along the guide member 9. As shown in FIG. 11, a substantially T-shaped coupler 60 is attached to the support leg 52 between the leg portions 52*a*. As shown in FIG. 11, the upper end of the coupler 60 which extend along the guide member 9 is attached to the support leg 52. That portion of the coupler 60 which extends downward or toward the guide member 9 penetrates the upper passage 10 of the guide member 9 through a slit 61 formed in the upper parts of the guide member 9. A pipe portion 62 is formed by bending the lower end portion of the coupler 60. The wire 63 is slidably passage through the pipe portion 62. Each end side of the wire 63 extends through the upper passage 10 of the guide member 9, passes through a pair of pipes 64 fixed to the driving belt 32 by means of a plate 65, as shown in FIG. 13, and is then bent upward. Both ends of the wire 63 are attached to the support leg 52 with the aid of metal fittings 66 and screws 67. Thus, the wire 63 forms a triangle with its base extending along the guide member 9, as shown in FIG. 11**.

In this manner, the driving belt 32 and the carriers 50 are coupled by means of the wires 63, so that the carriers 50 are driven along the guide member 9 as the driving belt 32 runs. Since the driving belt 32 normally runs inside the guide member 9 when the carriers 50 are driven, the driving belt 32 and the guide member 9 can prevent the carriers 50 from positively meandering on the base plate 1.

In this first embodiment, moreover, the support leg 52 is fitted with a restricting member 68 which extends toward the the guide member 9, as shown in FIG. 10. An arcuate portion 69 is formed at the lower end of the restricting member 68, facing the outer surface of the guide member 9 in contact therewith or with a narrow gap. With use of the restricting member 68 on the support leg 52 of each carrier 50, the carrier 50 can more securely be restrained from meandering when it runs.

As shown in FIGS. 1 and 2, the base plate 1 is mounted with a pair of slope plates 70 which are associated with the running of the carriers 50. The slope plates 70 are arranged along those end portions of the guide members 9 remote from the unit case 33. The slope plates 70 are located on the paths of transfer of the wheels 57 of the support legs 52. Thus, when those carriers 50 disposed closer to the slope plates 70 reach their corresponding slope plates 70, their wheels 57 are bound to run on the slope plates 70.

As shown in FIG. 10, four collars 71 are rotatably mounted on the hollow shaft 51 of each carrier 50 so as not to be movable in the axial direction of the shaft 51. Only two of the collars 71 are actually illustrated in FIG. 10. Massage rollers 72 are fitted individually on the collars 71. The massage rollers 72 are formed from a relatively hard elastic material, such as rubber, synthetic resin, etc. Each massage roller 72 is formed on its outer peripheral surface with a number of substantially hemispherical massage bumps 73 which are circumferentially arranged at regular intervals. The collars 71 are each provided with a pair of stoppers 74 for preventing the massage rollers 72 from moving axially.

The above described drive mechanism 30 is remotely controlled by a switch box (not shown), and the range of reciprocation of the carriers 50 can be adjusted by a conventional means (not shown).

Figure 14:
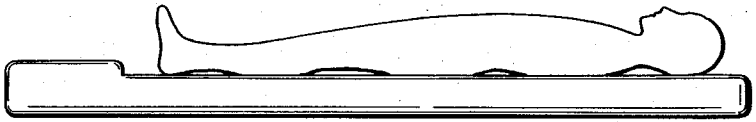
FIG. 14 illustrates the way the massage apparatus of the first embodiment is actually used.
Figure 15:
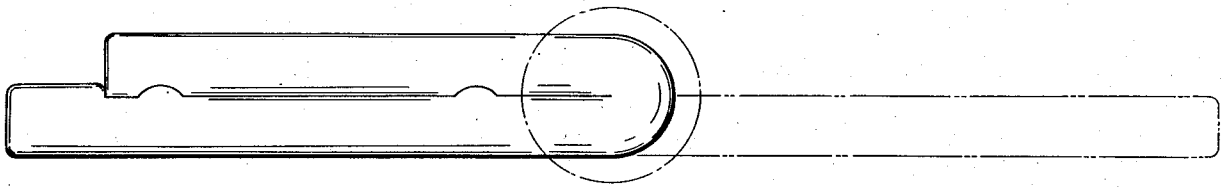
FIG. 15 shows the massage apparatus of the first embodiment in a folded state.

Referring now to FIG. 14 and 15, there will be described the way the user uses the massage apparatus according to the above-mentioned embodiment. As shown in FIG. 14, the user lies on the massage apparatus. In this state, if the user operates the remote switch to actuate the unit motor 36, the massage rollers 72 will reciprocate along the guide members 9 while rotating in contact with the inside of the wrapping cloth 8. Thus, the back of the user is massage by the massage bumps 73 of the massage rollers 72.

When not in use, the massage apparatus with this construction can be folded in two as shown in FIG. 15, since the central portions of the base plate 1 and the guide members 9 are expressly flexible. When storing the massage apparatus, therefore, its length can be halved, so that the storage space for the apparatus can be reduced. Moreover, the massage apparatus is handy to carry.

Figure 16:
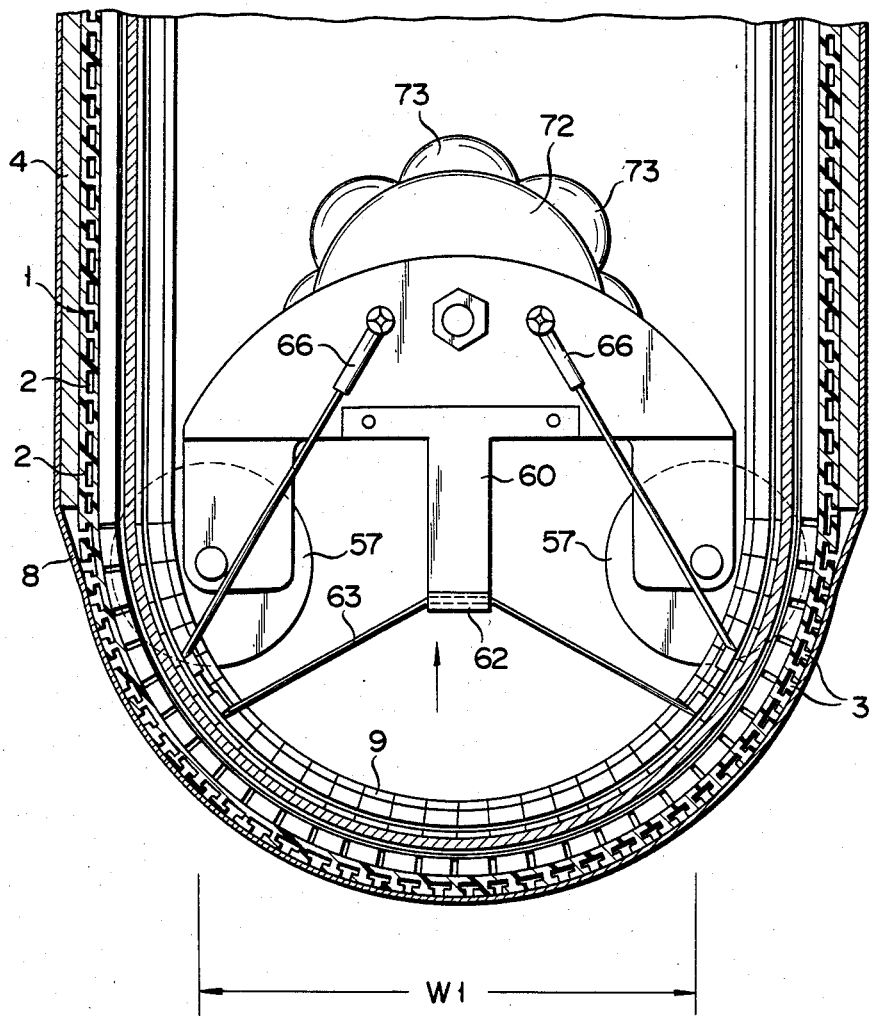
FIG. 16 is a sectional view of a fold portion of the massage apparatus of the first embodiment folded at the location of the carrier.

In this first embodiment, furthermore, only one end portion of each guide member 9 is fixed to the base plate 1 by means of the fixing screws 14, while the other end side of each guide member 9 is slidably held over the base plate 1 by means of the support members 15. Accordingly, the guide members 9 or the whole massage apparatus can easily be folded without producing any substantial bending stress in the guide members 9. According to the first embodiment, the massage apparatus can easily be folded even at the position where the carriers 50 is located. If the massage apparatus is folded at the location of the carrier 50, the base of the substantially triangular wire 63 is bent as shown in FIG. 16. As the wire 63 is bent in this manner, the carrier 50 is moved in the direction of arrow in FIG. 16, so that the massage apparatus can easily be folded without being substantially hindered by the carrier 50. If the distance between the pair of pipes 64 before the holding of the massage apparatus is w2, as shown in FIG. 11, the distance w1 between the pipes 64 after the folding is shorter than the distance w2 by a length for the flexure of the base of the wire 63. With the carrier 50 constructed in this manner, therefore, the massage apparatus can be folded with ease, and the fold portion can be made compact.

Figure 17:
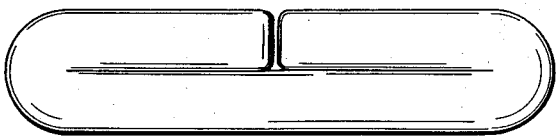
FIGS. 17 and 18 are side views showing massage apparatuses with increased folded portions.
Figure 18:
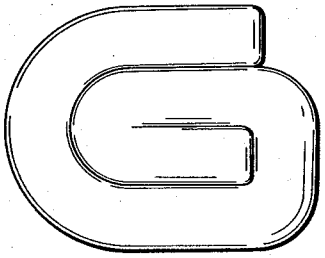

The above description is premised on an assumption that the massage apparatus is folded in two. Alternatively, however, the whole massage apparatus may be folded in the manner shown in FIGS. 17 or 18 by providing each of the base plate 1 and the guide members 9 with two or more predetermined fold portions or by making the base plate 1 and the guide members 9 foldable at any position in the aforementioned manner.

Referring now to FIGS. 19 to 22, there is shown a carrier 50' according to a second embodiment. In the carrier 50', the support leg 52 comprises a pair of first links 80 which are lockably mounted at the upper end portion thereof on each follow shaft 51. The lower end portions of the first links 80 spread away from each other, and are rotatably fitted with the wheels 57 by means of the support shafts 58. One end of each of a pair of second links 81 is rockably coupled to the support shaft 58 of each corresponding wheel 57. The other ends of the second links 81 are rockably coupled to a first coupler 82 by means of a pin 83. The first coupler 82 is fixed to the driving belt 32 guided through the upper passage 10 of the guide member 9. Second couplers 84 are attached to the support shafts 58 of their corresponding wheels 57. The support shafts 58 of the wheels 57 are passed through guide holes 85 in their corresponding second couplers 84, and the second couplers 84 are fixed to the driving belt 32 in the guide member 9 in the same manner as the first coupler 82.

Figure 22:
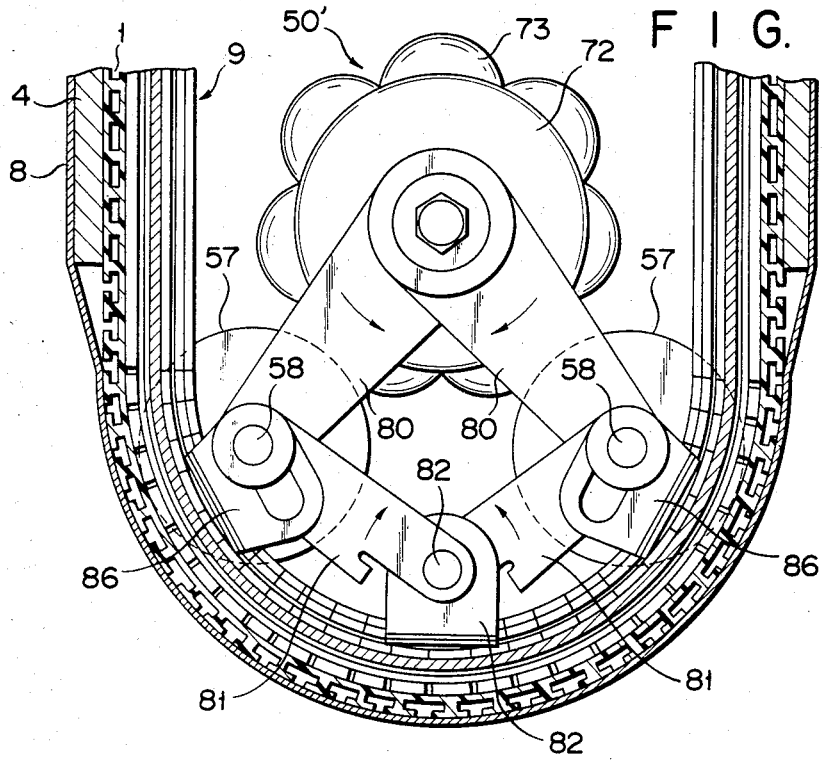
FIG. 22 is a sectional view of a folded portion of a massage apparatus having the carrier of FIG. 19, folded at the location of the carrier.

Thus, as seen from FIG. 22, the carrier 50' of the second embodiment can provide the same function and effect as those of the carrier 50 of the first embodiment.

Figure 19:
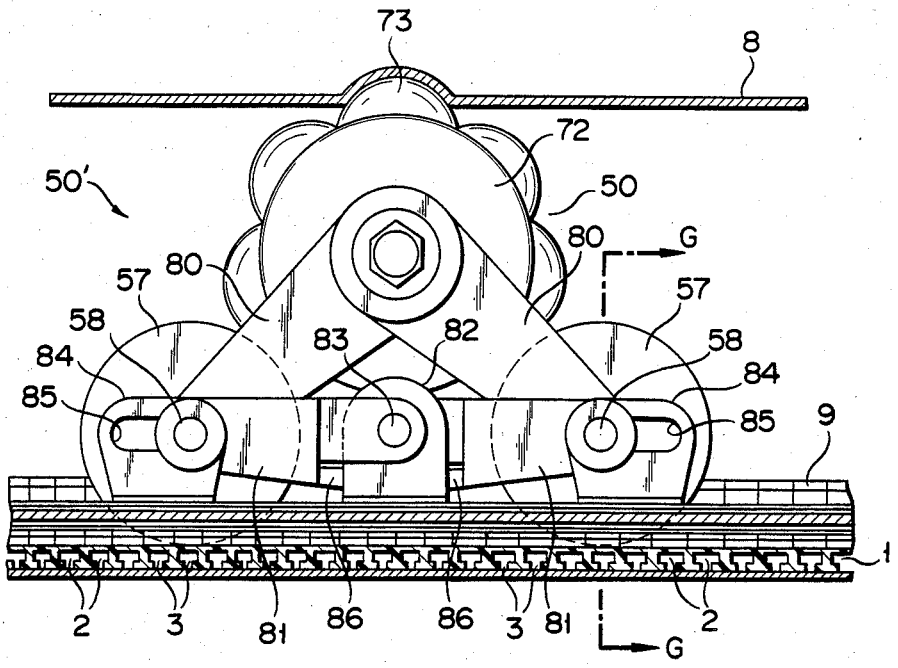
FIG. 19 is a side view showing a carrier according to a second embodiment of the invention.
Figure 20:
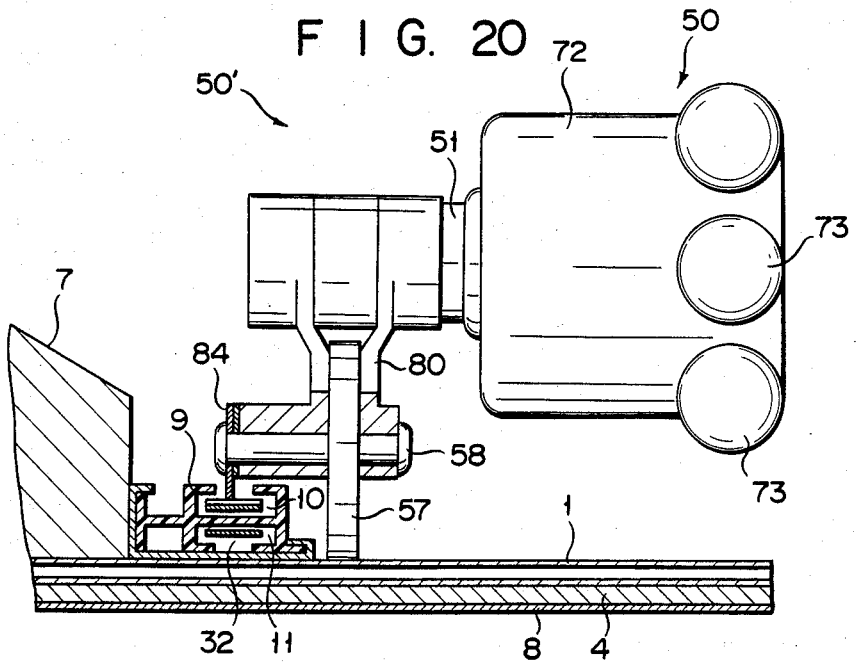
FIG. 20 is a sectional view taken along line G—G of FIG. 19.
Figure 21:
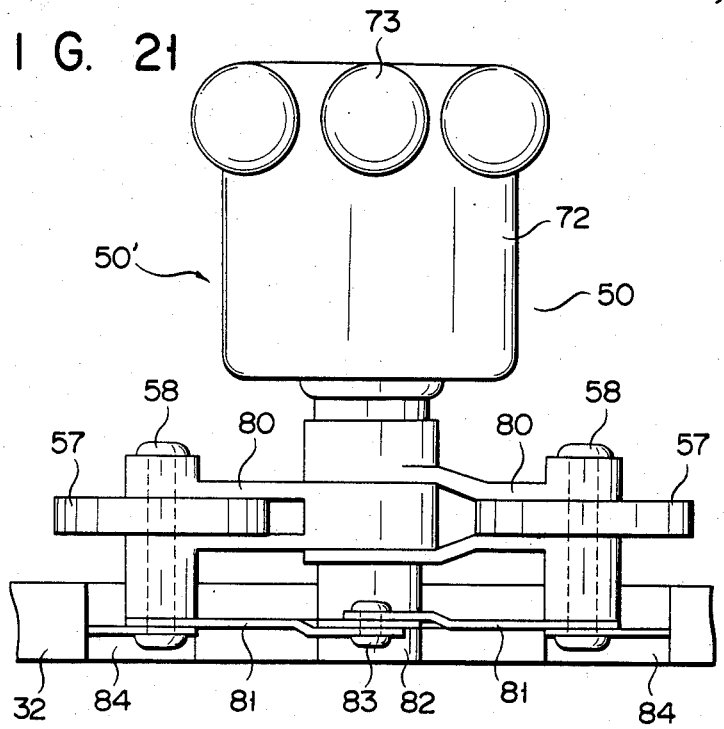
FIG. 21 is a plan view of the carrier shown in FIG. 19.

In FIG. 19, numeral 86 designates stoppers attached to the second links 81. The stoppers 86 are adapted to abut against the side faces of the first coupler 82, thereby preventing the second links 81 from rocking further downward.

Figure 23:
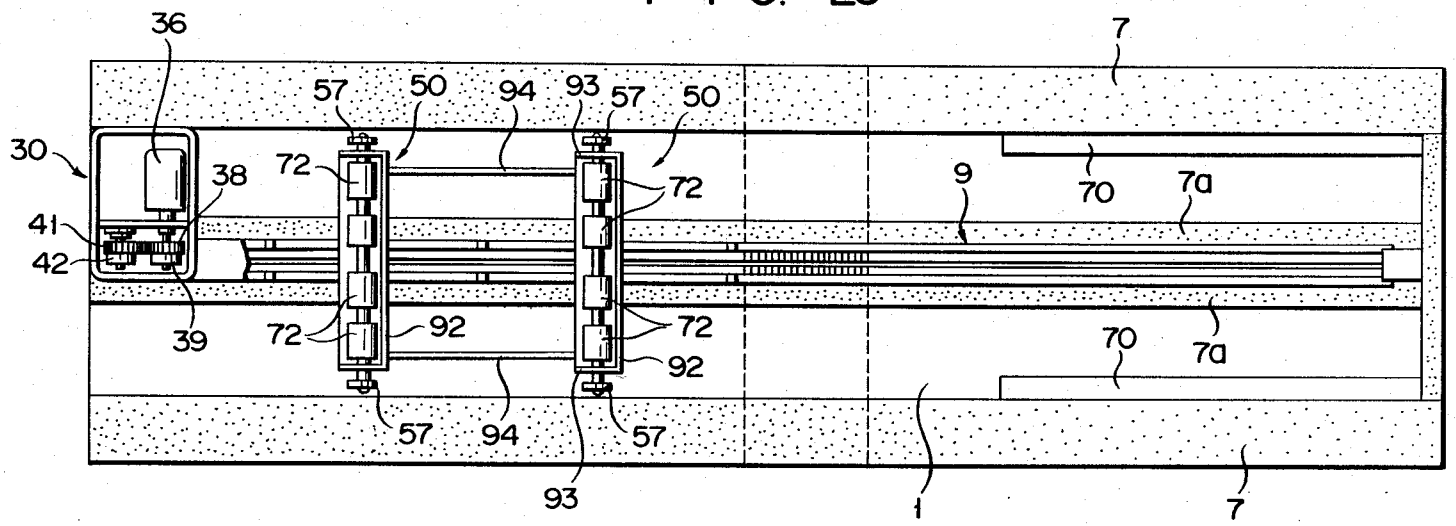
FIG. 23 is a plan view of a massage apparatus according to a third embodiment of the invention with its wrapping cloth removed.
Figure 24:
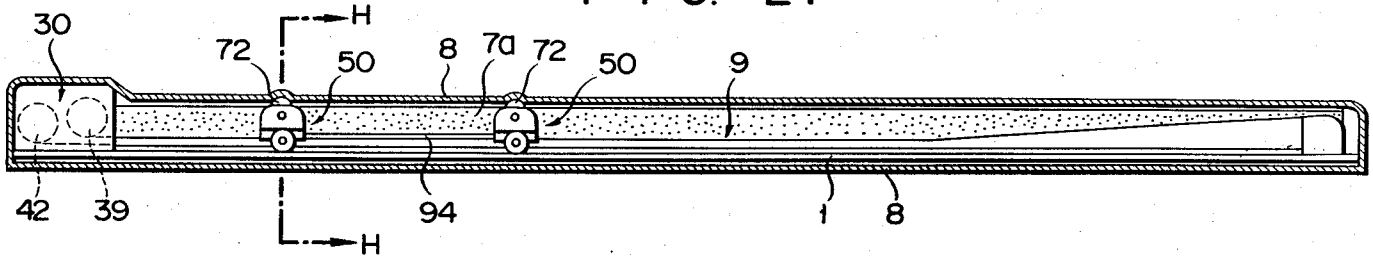
FIG. 24 is a sectional view of the massage apparatus of FIG. 23.
Figure 25:
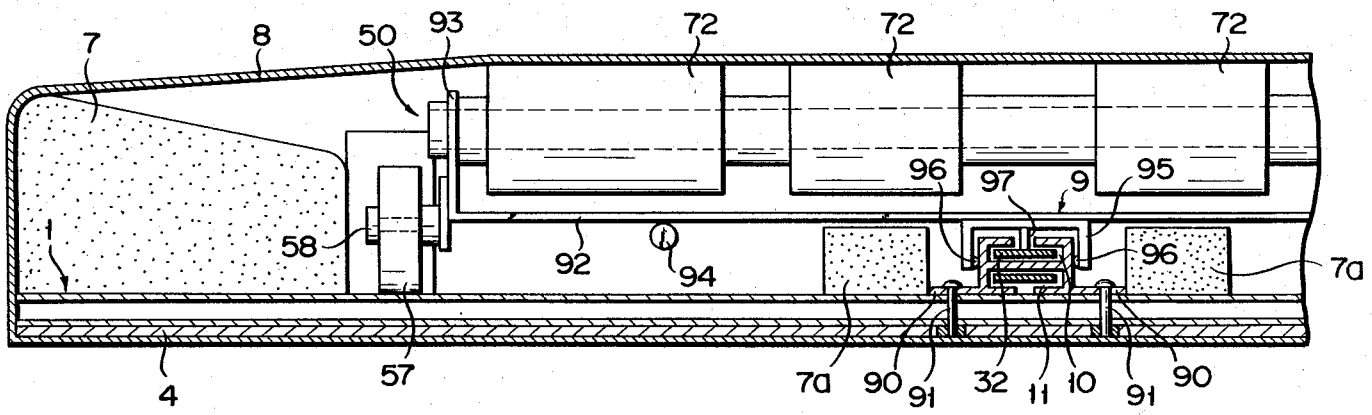
FIG. 25 is a sectional view taken along line H—H of FIG. 24.

Referring now to FIGS. 23 to 25, a massage apparatus according to a third embodiment of the invention will be described. The massage apparatus of this embodiment, unlike the apparatus of the first embodiment, comprises only a single guide member 9 which is located on the central portion of the base plate 1 as viewed crosswise. As shown in FIG. 25, this guide member 9 has a cross section similar to those of the guide members 9 of the first embodiment. The guide member 9 of the third embodiment, however, is formed integrally with fitting strips 90 which extend sideways from the lower ends of the two side walls of the guide member 9. Thus, the guide member 9 is retained on the base plate 1 by fixing the fitting strips 90 to the base plate 1 by means of screws 91.

In the massage apparatus of the third embodiment, as described above, the number of guide members 9 is reduced, so that the construction of the drive mechanism 30 is different from that of the first embodiment. Namely, the drive mechanism 30 of the third embodiment comprises driving and driven gears 38 and 41 and driving and driven pulleys 39 and 42 which are just required for driving a single driving belt 32 which is guided through the single guide member 9.

Each carrier 50 of the third embodiment is provided with a support frame 92 in place of the support legs 52 of the first embodiment. The support frame 92, which extends in the longitudinal direction of the carrier 50, is formed integrally at each end with an upwardly extending support wall 93. The two support walls 93 of the support frame 92 support a hollow shaft 51 with massage rollers 72 thereon in the same manner as in the first embodiment. Massage bumps 73 are omitted from the massage rollers 72 shown in FIG. 25. The support walls 93 of the support frame 92 are fitted individually with wheels 57 which can run on a base plate 1. As shown in FIG. 23, the two carriers 50 or support frames 92 spaced in the longitudinal direction of the guide member 9 are coupled to each other by means of two coupling rods 94.

As shown in FIG. 25, a restricting member 95 is fixed to the undersurface of the support frame 92 of each carrier 50, bestriding the guide member 9. The restricting member 95 is provided with hemispherical protrusions 96 which are directly in contact with the two side walls of the guide member 9 or face the same with narrow gaps. The restricting member 95 is coupled by means of a coupling member 97 to the driving belt 32 which is guided through an upper passage 10 of the guide member 9.

As seen from FIGS. 23 and 25, a pair of elastic members 7a are arranged on either side of the guide member 9, extending along the same. The elastic members 7a serve to keep the body of a user lying on the massage apparatus of the third embodiment from touching the guide member 9.

In the massage apparatus of the third embodiment described above, as in the apparatus of the first embodiment, the two carriers 50 can be reciprocated in the longitudinal direction of the guide member 9 by reciprocating the driving belt 32. Thus, the user's body can be massaged by the massage rollers 72 of the carriers 50. When not in use, the massage apparatus of the third embodiment can also be folded at least in two, permitting a reduction of the storage space therefor.

Figure 26:
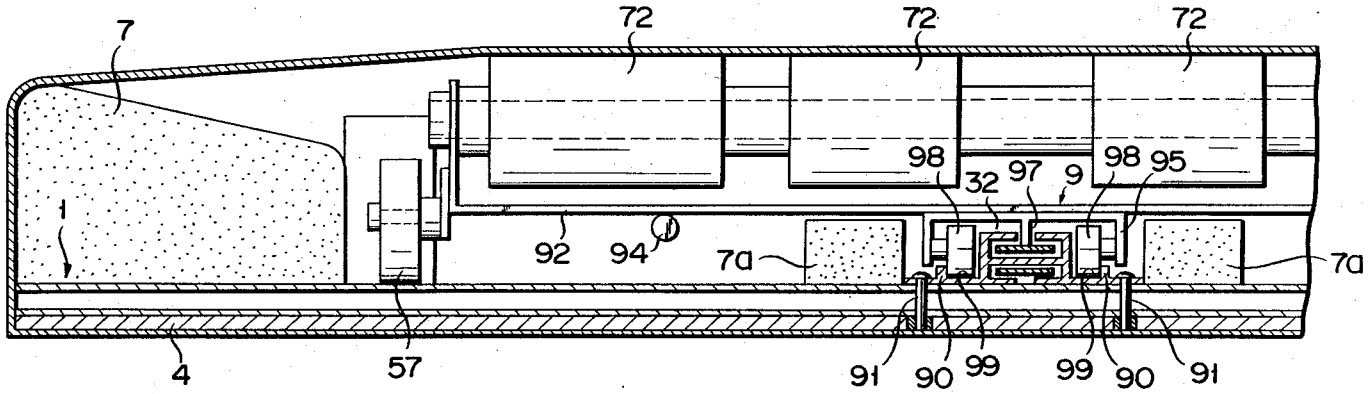
FIG. 26 is a sectional view showing a massage apparatus according to a fourth embodiment of the invention.

Referring now to FIG. 26, there is shown a massage apparatus according to a fourth embodiment of the invention. The massage apparatus of this embodiment has basically the same construction as the apparatus of the third embodiment. The two massage apparatuses are different only in the construction of the restricting member 95. In the apparatus of the fourth embodiment, the restricting member 95 is rotatably fitted with a pair of rollers 98 in place of the hemispherical protrusions 96. The rollers 98 are allowed to run within guide grooves 99 which are integrally formed in both side portions of a guide member 9, extending in the longitudinal direction of the guide member 9.

Figure 27:
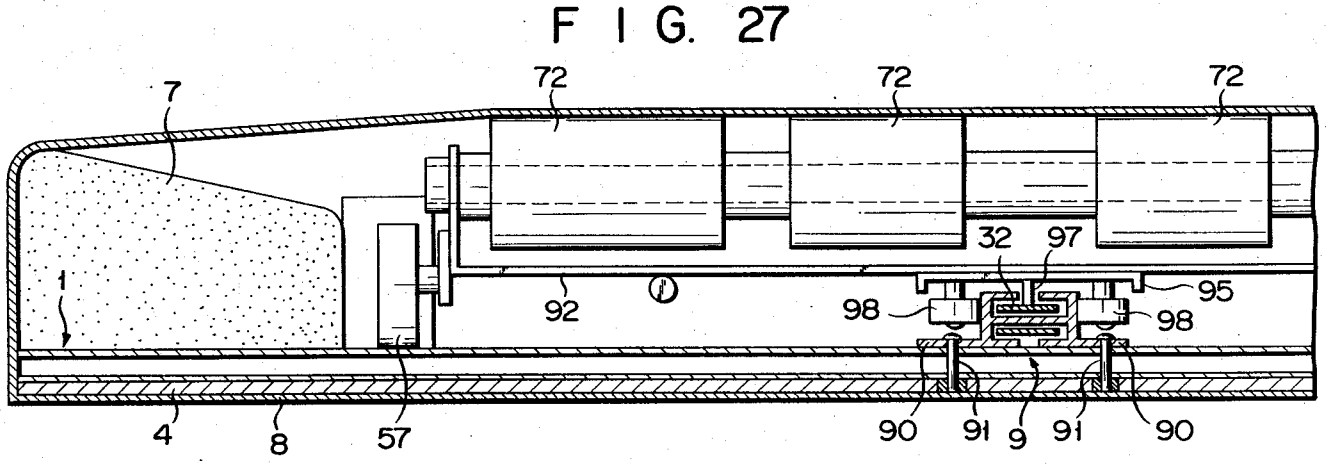
FIG. 27 is a sectional view showing a massage apparatus according to a fifth embodiment of the invention.
Figure 28:
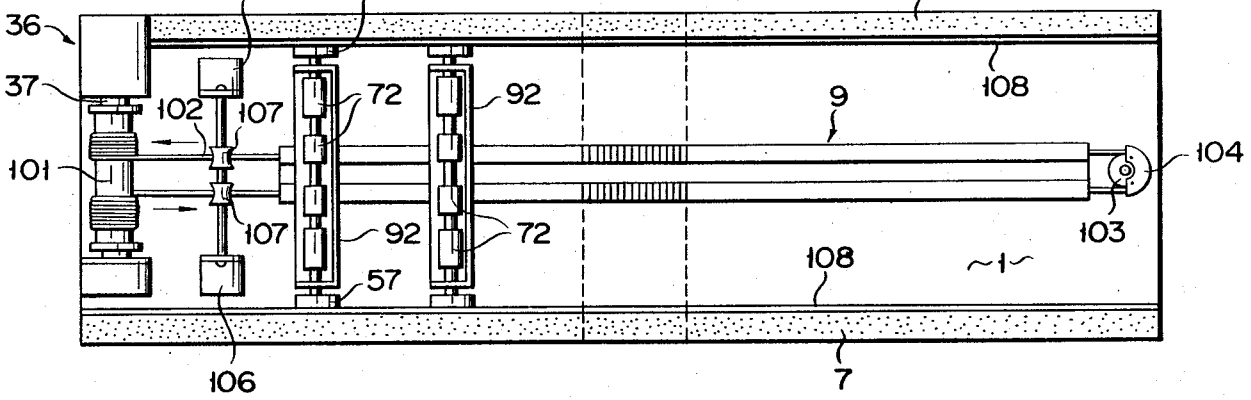
FIG. 28 is a plan view of a massage apparatus according to a sixth embodiment of the invention with its wrapping cloth removed.

Referring now to FIG. 27, there is shown a massage apparatus according to a fifth embodiment of the invention. Like the massage apparatus of the fourth embodiment, the apparatus of the fifth embodiment comprises a restricting member 95 with rollers 98. Unlike the rollers 98 of the fourth embodiment, however, the rollers 98 of the fifth embodiment are in rolling contact with both side walls of a guide member 9.

Figure 29:
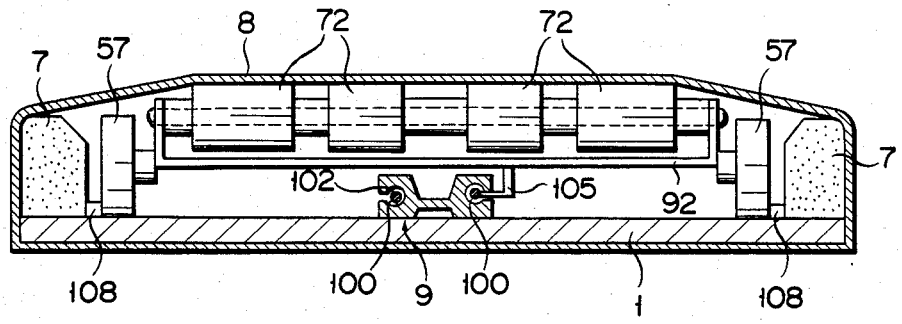
FIG. 29 is a sectional view of the massage apparatus of FIG. 28.
Figure 30:
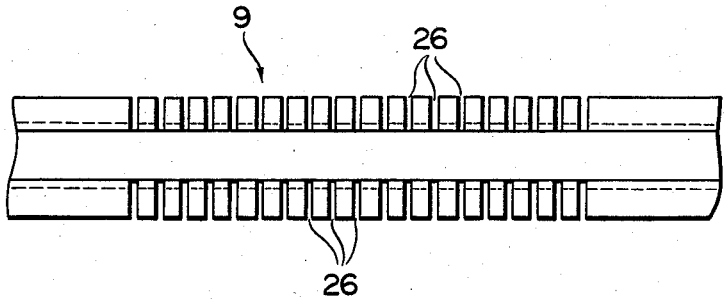
FIG. 30 is a plan view showing part of a guide member used in the massage apparatus of FIG. 28.
Figure 31:
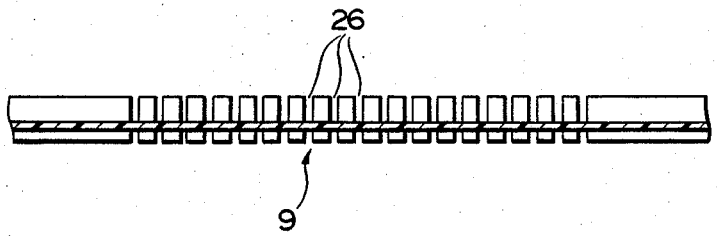
FIG. 31 is a sectional view of the guide member shown in FIG. 30.

Referring finally to FIGS. 28 to 31, there is shown a massage apparatus according to a sixth embodiment of the invention. The massage apparatus of this embodiment differs from the apparatus of the third embodiment in the construction of the guide member 9 and the drive mechanism 30. The guide member 9 of the sixth embodiment has a substantially H-shaped cross section, as shown in FIG. 29, and a pair of guide passages 100 are formed individually in the two side walls of the guide member 9, in place of the upper and lower passages 10 and 11. As shown in FIGS. 30 and 31, the guide member 9 of the sixth embodiment, like the guide members 9 of the first embodiment, is formed with a number of slits 26 arranged at regular intervals in its central portion as viewed along the longitudinal direction thereof. Thus, the guide member 9 of the sixth embodiment, along with the base plate 1, can also be folded at the region for the slits 26.

The drive mechanism 30 of the sixth embodiment, like the mechanism of the first embodiment, includes a unit motor 36. A drum 101 is mounted on an output shaft 37 of the unit motor 36. One end portion of a driving wire 102 replacing the driving belt 32 is fixedly wound around the drum 101. The other end side of the driving wire 102 extends from the drum 101 through one of the guide passages 100 of the guide member 9 to a pulley 103 which is disposed close to the end portion of the guide member 9 on the opposite side to the drum 101. After being passed around the pulley 103 for a change of direction for 180°, the other end side of the driving wire 102 extends through the other guide passage 100 of the guide member 9 and is then wound around the drum 101 so that its extreme end is fixed to the drum 101. Here it is to be noted that the two end portions of the driving wire 102 are wound in opposite directions around the drum 101. Also, the pulley 103 is fitted with a cover 104 for preventing the driving wire 102 from being disengaged.

One end of each of a pair of coupling members 105 (only one shown) is connected to the driving wire 102. The other ends of the coupling members 105 are coupled to the support frames 92 of their corresponding carriers 50.

A pair of brackets 106 are fixed to those portions of the base plate 1 close to the drive mechanism 30 so as to face each other with the driving wire 102 between them. A pulley 107 is rotatably attached to each bracket 106 by means of a shaft. The two pulleys 107 serve to guide the driving wire 10 in travel and to restrict the height of the running driving wire 102 above the surface of the base plate 1.

Moreover, the massage apparatus according to the sixth embodiment is provided with a pair of belt-shaped restricting members 108 which function like the restricting member 95. As shown in FIG. 29, the restricting members 108 serve to guide running wheels 57 of the carriers 50.

Also in the massage apparatus of the sixth embodiment, when the unit motor 36 is driven to rotate the drum 101, for example, in the clockwise direction, the driving wire 102 is let out from the wire roll portion at which it is wound in the same direction as the rotating direction of the drum 101, while the driving wire 102 is additionally wound around the other wire roll portion at which it is wound in the opposite direction. Accordingly, the driving wire 102 is driven in the direction indicated by arrows in FIG. 28. Since the driving wire 102 is coupled to the carriers 50 as aforesaid, the carriers 50 or the massage rollers 72 are reciprocated as the driving wire 102 runs.

When not in use, the massage apparatus of the sixth embodiment, like the apparatuses of the foregoing embodiments, can be folded for storage, owing to the arrangement of the slits 26 in the central portion of th guide member 9.

What is claimed is:

1. A massage apparatus comprising:

an elongate base plate foldable at least in two;

at least one carrier capable of running on the base plate, said carrier having at least one massage roller;

drive means for reciprocating the carrier in the longitudinal direction of the base plate, said drive means including at least one elongate member extending in the longitudinal direction of the base plate and coupled to the carrier and a drive source for driving the elongate member for reciprocation; and at least one guide member disposed on the base plate so as to extend in the longitudinal direction thereof and foldable together with the base plate, said guide member including passage means for guiding the drive of the elongate member thereby guiding the running carrier.

2. An apparatus according to claim 1, wherein said base plate is made of synthetic resin and formed with a number of slits arranged at regular intervals in a direction perpendicular to the longitudinal direction of the base plate in the central portion thereof or a portion close to the central portion, so that the base plate can be folded at a fold portion corresponding to the region for the slits.

3. An apparatus according to claim 2, wherein a pair of guide members made of synthetic resin are arranged at a predetermined space on the base plate, and a number of slits are formed in those regions of the guide members corresponding to the fold portion of the base plate, in the same manner as the slits in the base plate.

4. An apparatus according to claim 3, wherein said drive means includes a reversible electric motor as the drive source, a pair of first pulleys arranged for each said guide member on one end side thereof and adapted to be rotated in opposite directions by the electric motor, a second pulley disposed on the other end side of each said guide member, and a pair of driving belts as the elongate member guided by the respective passage means of the guide members, each said driving belt including a winding portion wound around one of the first pulleys with one end thereof fixed to the one first pulley, so that the driving belt extends from the winding portion to the second pulley through the passage means of the guide member, is passed around the second pulley for a change of direction, extends again through the passage means of the guide member, and is wound around the other first pulley with the other end thereof fixed thereto.

5. An apparatus according to claim 4, wherein the passage means of each said guide member includes two passages for guiding each corresponding driving belt.

6. An apparatus according to claim 2, wherein a single guide member made of synthetic resin is disposed on the central portion of the base plate, and a number of slits are formed in that region of the guide member corresponding to the fold portion of the base plate, in the same manner as the slits in the base plate.

7. An apparatus according to claim 6, wherein said drive means includes a reversible electric motor as the drive source, a pair of first pulleys arranged on one end side of the guide member and adapted to be rotated in opposite directions by the electric motor, a second pulley disposed on the other end side of the guide member, and a driving belt as the elongate member guided by the passage means of the guide member, said driving belt including a winding portion wound around one of the first pulleys with one end thereof fixed to the one first pulley, so that the driving belt extends from the winding portion to the second pulley through the passage means of the guide member, is passed around the second pulley for a change of direction, extends again through the passage means of the guide member, and is wound around the other first pulley with the other end thereof fixed thereto.

8. An apparatus according to claim 7, wherein the passage means of said guide member includes two passages for guiding the driving belt.

9. An apparatus according to claim 6, wherein said drive means includes a reversible electric motor as the drive source, a drum disposed on one end side of the guide member and adapted to be rotated by the electric motor, a pulley disposed on the other end side of the guide member, and a driving wire as the elongate member guided by the passage means of the guide member, said driving wire including a winding portion wound around the drum with one end thereof fixed to the drum, so that the driving wire extends from the winding portion to the pulley through the passage means of the guide member, is passed around the pulley for a change of direction, extends again through the passage means of the guide member, and is wound around the drum in a direction opposite to the winding direction of the winding portion with the other end thereof fixed to the drum.

10. An apparatus according to claim 1, further comprising restraining means for restraining the carrier from meandering while the carrier is being reciprocated.

11. An apparatus according to claim 10, wherein said restraining means includes a restricting member one end of which is coupled to the carrier and the other end of which is in sliding contact with the guide member.

12. An apparatus according to claim 11, wherein that part of the restricting member in sliding contact with the guide member is in the form of a hemispherical protrusion.

13. An apparatus according to claim 10, wherein said restraining means includes a restricting member coupled at one end to the carrier and provided at the other end with a roller in rolling contact with the guide member.

14. An apparatus according to claim 3, wherein said carrier includes a shaft member stretched between the guide members and fitted with at least one massage roller, support legs one end of which is attached to the shaft member and the other end of which is movably disposed over said base plate by means of a pair of wheels spaced along said guide member, and coupling means for coupling the support leg and the elongate member.

15. An apparatus according to claim 14, wherein the coupling means includes a wire coupled at each end to the support leg and bent in the form of a triangle with its base extending along said guide member, a first coupler coupled at one end to the support leg and having at the other end a guide portion through which is slidably passed the central portion of the base of the triangular wire, and a pair of second couplers coupled to the elongate member and each having a guide portion through which is slidably passed each corresponding end of the base of the triangular wire.

16. An apparatus according to claim 14, wherein the support leg has a pair of first links one end of which is rockably attached to the shaft member and the other end of which is each fitted with a wheel by means of a support shaft, a pair of second links one end of which is rockably attached to the other end of the corresponding first links and the other end of which is rockably coupled to each other, a first coupler for coupling the other ends of the second links to the elongate member, and second couplers for coupling the other ends of the first links to the elongate member, each of the second couplers having a guide hole in which the support shaft of each corresponding wheel is loosely fitted.

* * * * *